US005893586A

United States Patent [19]

McGuire

[11] Patent Number: 5,893,586

[45] Date of Patent: Apr. 13, 1999

[54] COMBINATION CARD AND CALENDAR

[76] Inventor: Stacy McGuire, 1332 Buckingham Cir., Franklin, Tenn. 37064

[21] Appl. No.: 08/800,359

[22] Filed: Feb. 14, 1997

[51] Int. Cl.[6] ..... B42D 5/04

[52] U.S. Cl. ..... 283/2; 283/61; 283/62; 283/101; 283/105; 283/106; 281/2; 281/5

[58] Field of Search ..... 283/2, 3, 4, 61, 283/62, 101, 105, 106; 281/2, 5; 40/121, 122, 124.04, 124.11, 124.12, 621

[56] References Cited

U.S. PATENT DOCUMENTS

| | | | |
|---|---|---|---|
| 1,371,269 | 3/1921 | Stevens . | |
| 1,828,084 | 10/1931 | Swan . | |
| 2,128,989 | 9/1938 | Dickerson . | |
| 2,228,517 | 2/1941 | Hawkins . | |
| 2,263,528 | 11/1941 | Wissman | 283/2 |
| 3,605,306 | 9/1971 | Diambra . | |
| 4,176,478 | 12/1979 | Brewer . | |
| 4,800,662 | 1/1989 | Belrose | 40/621 |
| 4,819,963 | 4/1989 | Wolski . | |
| 4,902,042 | 2/1990 | Rassi | 283/2 |
| 4,948,034 | 8/1990 | Rohloff . | |
| 5,339,546 | 8/1994 | Rahwan . | |
| 5,641,550 | 6/1997 | Berman et al. | 281/2 |

FOREIGN PATENT DOCUMENTS

| | | | |
|---|---|---|---|
| 6303 | 3/1913 | United Kingdom | 281/31 |

*Primary Examiner*—Frances Han
*Attorney, Agent, or Firm*—LaValle D. Ptak

[57] ABSTRACT

A combined greeting card and calendar includes a calendar backing panel, which has first and second portions separated by a horizontal fold line. A card portion is formed from the same stock as the calendar backing portion and comprises a rectangular card, which is attached to the first portion of the calendar backing panel at a second fold line perpendicular to the horizontal fold line between the two portions of the calendar backing panel. A magnetic fastener may be attached to the back of the calendar backing panel to secure it to a metal surface.

12 Claims, 2 Drawing Sheets

COMBINATION CARD AND CALENDAR

BACKGROUND

Display calendars made of folded sheets attached to some type of backing are well known. Typically, the sheets include a calendar on one side and a pictorial display on the other, such that when the calendar is used, the pictorial display is lifted upwardly to overlie the backing to expose each new month in order. Consequently, a twelve-month calendar is printed on six sheets, which generally are creased or folded at the center on a horizontal fold to produce a monthly display of each of the twelve months with a different (if desired) pictorial portion for each different month. Typically, the current month hangs beneath the page for the previous month when the calendar is placed on the wall or some other surface.

Efforts have been made to incorporate other features into such a generally standard calendar configuration. The U.S. patents to Rohloff U.S. Pat. No. 4,948,034 and Dickerson U.S. Pat. No. 2,128,989 both are directed to card/calendar combinations. In the Rohloff patent, the card is a fold-over card which is separately adhered to a panel of the card/calendar device. The entire unit is made to fold together to form an enclosed envelope. Multiple parts, which require expensive construction, are involved in the device of this patent; and all of the folds of the various parts are parallel to one another.

The Dickerson patent and U.S. patents to Hawkins U.S. Pat. No. 2,228,517 and Diambra U.S. Pat. No. 3,605,306 disclose display calendar structures having multiple sections (typically, three). All of the folds between the sections are parallel to one another; and different ones of the sections may be used for displaying advertising copy, greeting instructions or other information. The structure, however, of the calendars disclosed in all of these patents is one in which all of the parts are folded along parallel fold lines.

Another approach to a multi-function or multi-purpose calendar is disclosed in the U.S. patent to Rahwan U.S. Pat. No. 5,339,546. This patent discloses a combined notepad, phone number reminder, calendar and storage device of a relatively complex structure. The back panel of the device of the Rahwan patent is made of or is coated with magnetic material to permit the calendar to adhere to a metal surface, such as a refrigerator or the like.

It is desirable to provide an improved combined calendar and greeting card in which the greeting card part may be opened along a vertical fold and viewed in a normal manner while the remainder of the calendar part functions as a wall display calendar with a horizontal fold between pictorial portions and calendar display portions.

SUMMARY OF THE INVENTION

It is an object of this invention to provide an improved card and calendar combination.

It is another object of this invention to provide an improved card and calendar combination in which a greeting card portion comprises a card with a vertical fold and the calendar portion is suitable for mounting on a surface, with horizontal folds for revealing each new month.

It is another object of this invention to provide an improved greeting card and calendar combination in which the greeting card is selectively removable to facilitate mounting of the calendar.

It is a further object of this invention to provide an improved greeting card and wall display calendar in which the greeting card is folded over the upper back portion of the display calendar and is selectively removable to expose an attaching device for facilitating attachment of the calendar to a vertical surface.

In accordance with a preferred embodiment of this invention, a combined card and calendar device includes a calendar backing panel substantially comprising first and second portions separated by a fold line, with a card portion attached to the first portion of backing panel adjacent one edge thereof along a fold line which is perpendicular to the fold line between the first and second portions of the calendar backing panel.

DETAILED DESCRIPTION

Figure 1:
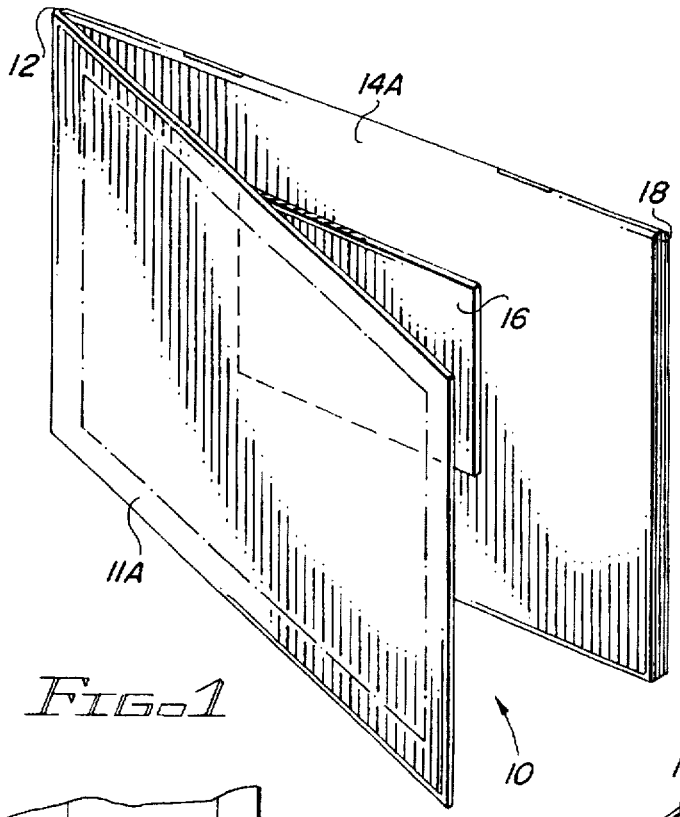
FIG. 1 is a front perspective view of a preferred embodiment of the invention.
Figure 2:
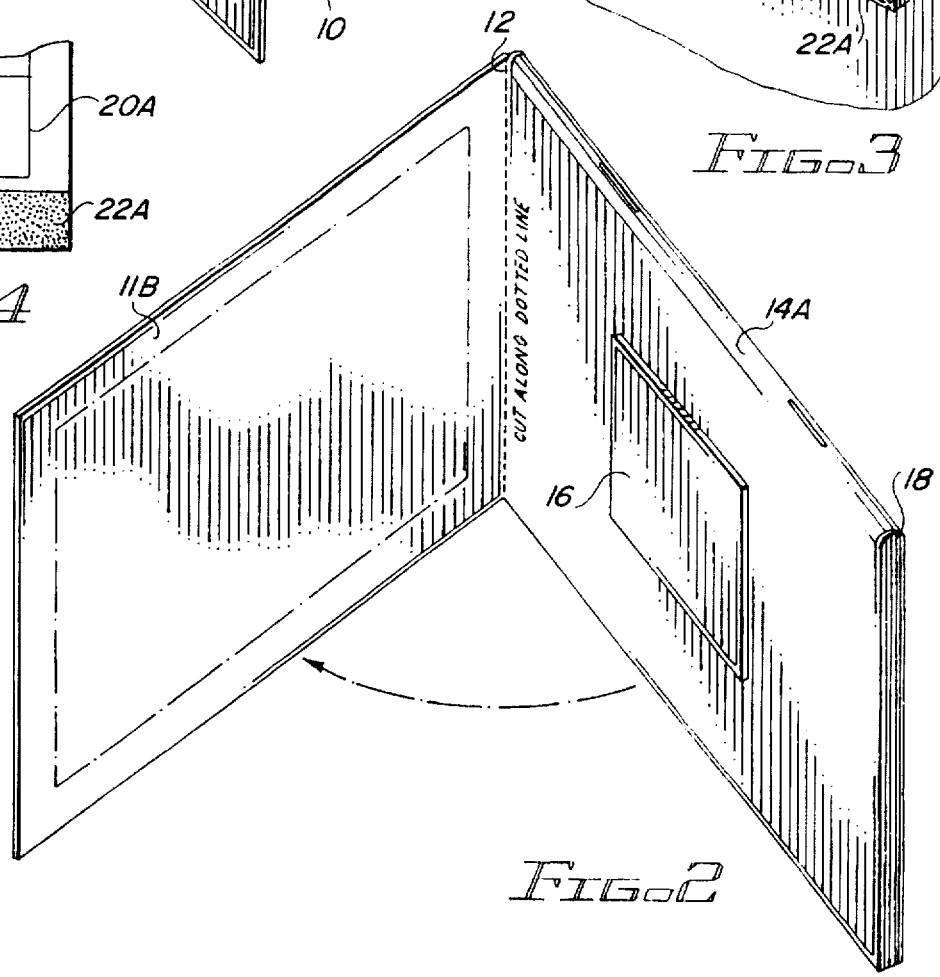
FIG. 2 is another perspective view of a preferred embodiment of the invention illustrating a feature of the invention.

Reference now should be made to the drawings in which the same reference numbers are used throughout the different figures to designate the same components. FIGS. 1 and 2 are front perspective views of the combination card/calendar 10 illustrating a card panel with front and back surfaces 11A and 11B, respectively. As shown in FIGS. 1, 2, 5 and 6, the panel 11A/11B is attached at a fold line or hinge along its left-hand edge (as viewed in FIG. 1) to overlie the rear side of a folded over calendar panel 14A, as illustrated most clearly in FIGS. 1 and 2. As a result, the side 11A of the card panel may be printed with any suitable indicia in the manner of a conventional greeting card or the like. When the panel 11A is folded outwardly in the direction of the arrow in FIG. 2, the side 11B is exposed. This side may carry any suitable message or greeting. In addition, when the panel 11A/11B is moved outwardly along the fold or hinge line 12 as illustrated in FIG. 2, the rear surface of the upper panel 14A of a two part calendar backing panel 14A/14B is exposed. This surface also may carry suitable printed indicia corresponding with that printed on the card panel 11A/11B, if desired.

Figure 5:
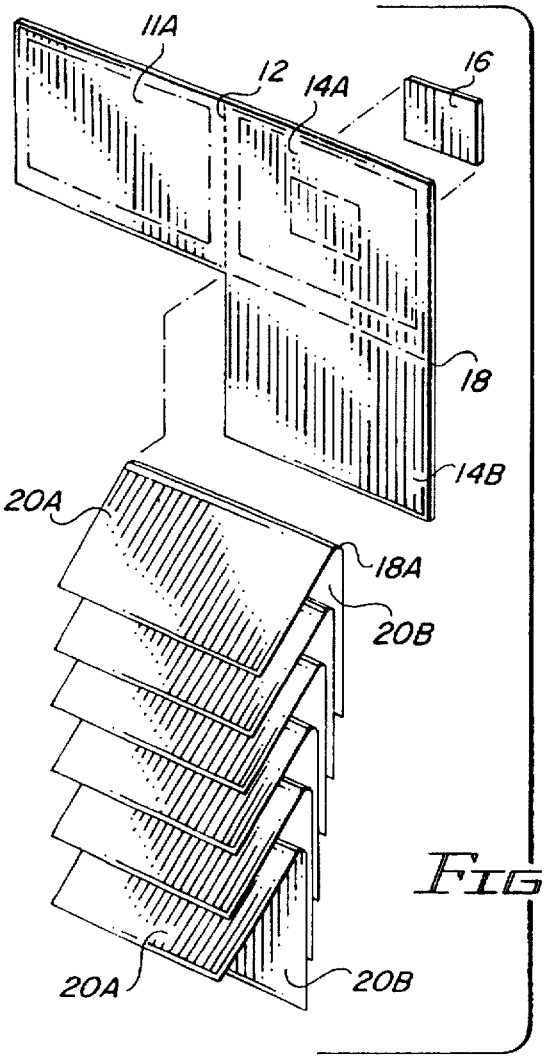
FIG. 5 is an exploded view of the preferred embodiment of the invention showing the various parts used in its assembly.

The structure of the overall card/calendar is best illustrated in the exploded view of FIG. 5. FIG. 5 is a rear view of the calendar assembly showing the card 11A/11B attached by the vertical fold 12 to the edge of the upper portion of 14A of the main calendar backing panel 14A/14B. The fully folded-out panel 11A/11B lies in the same plane as the panels 14A and 14B.

Figure 6:
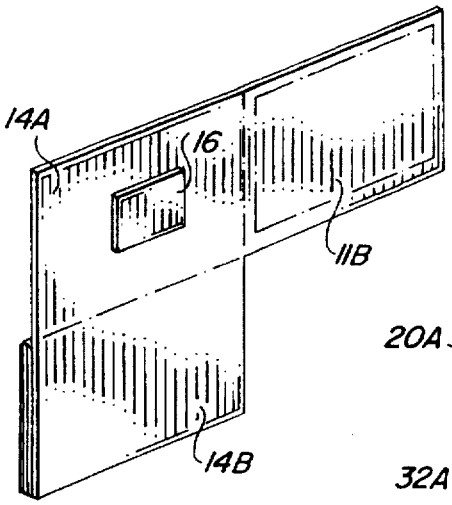
FIG. 6 is a rear view of the assembled embodiment of the invention shown in FIG. 5.

As indicated in FIG. 5, the upper portion 14A of the backing panel 14A/14B is hinged to the lower portion 14B by means of a horizontal hinge or fold line 18, as is readily apparent from an examination of FIGS. 5 and 6, in particular. The fold line or hinge 12 is perpendicular to, or at right angles to, the fold line or hinge 18 in the structure of the card/calendar device.

Figure 7:
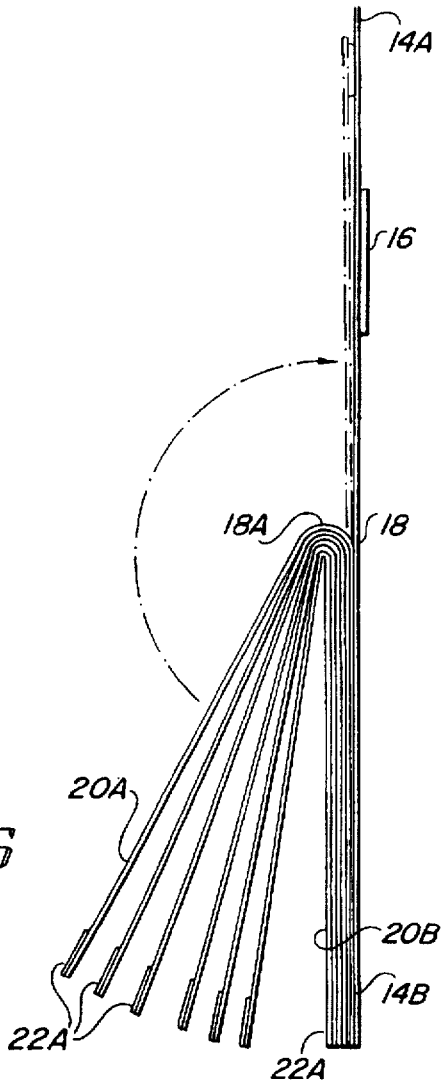
FIG. 7 is a side view illustrating features of the invention.

Also as shown in FIG. 5, six folded sheets comprising an upper portion 20A and a lower portion 20B of a size corresponding to the size of the backing panel 14A/14B are attached to the backing panel 14A/14B at hinge lines or folds 18A at the hinge line or fold 18 in the backing panel 14A/14B. The sheets 20A, 20B are folded over in the manner shown in FIGS. 5 and 7 to provide indicia corresponding to a normal calendar for the twelve months of the year. As is shown in these figures, the sheets are nested together or stacked, and then folded together, as shown most clearly in FIG. 7. Consequently, the surfaces 20A all are printed on the downward facing side (as shown in FIGS. 5 and 7) with the first six months of the year. The front side of the panel 14A has a printed indicia on it which may be of any suitable type, such as a photograph, painting, artwork or other text primarily used for decorative purposes. Each month, the top one of the sheets 20A/20B is folded upwardly on the fold 18A from the position shown in FIGS. 3, 5 and 7 to cause the reverse side of each of the sheet portions 20A to overlie the backing panel 14A, as illustrated by the arrow in FIG. 7. Consequently, the reverse side of each of the six sheet portions 20A also carries a pictorial or text indicia on it, used for decorative purposes in a standard manner.

For the last six months of the year, the face or front sides of each of the portions 20B are printed with the calendars for July through December. The reverse sides of these sheets then is printed with pictorial or text indicia to be folded upwardly and to overlie the panel 14A. The result is that, for the first half of the year, the sheet portions 20A extend downwardly over the portions 20B. For the second half of the year, the portions 20B are folded upwardly to overlie the panel 14A. By the end of the year, all of the panels 20A/20B are folded upwardly along the fold line or hinge 18A to overlie the panel 14A instead of the panel portion 14B, as illustrated for the beginning of the year in FIGS. 3, 5 and 7.

If the card/calendar is to be hung on a wall, the card panel 11A/11B simply can be folded over the rear side 14A of the upper portion of the backing panel 14A, 14B and hung on a wall in a standard manner (typically on a nail through aligned holes, not shown, in the panels 11 and 14). Alternatively, however, the card portion 11A/11B may be removed from the panel 14A by cutting it or tearing it off along the fold line 12. This permits the greeting card portion 11A/11B of the combination to be kept in a place apart from the calendar to which it originally was attached. This also permits the attachment of a flat rubberized magnet or other suitable fastener 16 on the rear surface 14A of the backing panel 14A/14B.

Figure 3:
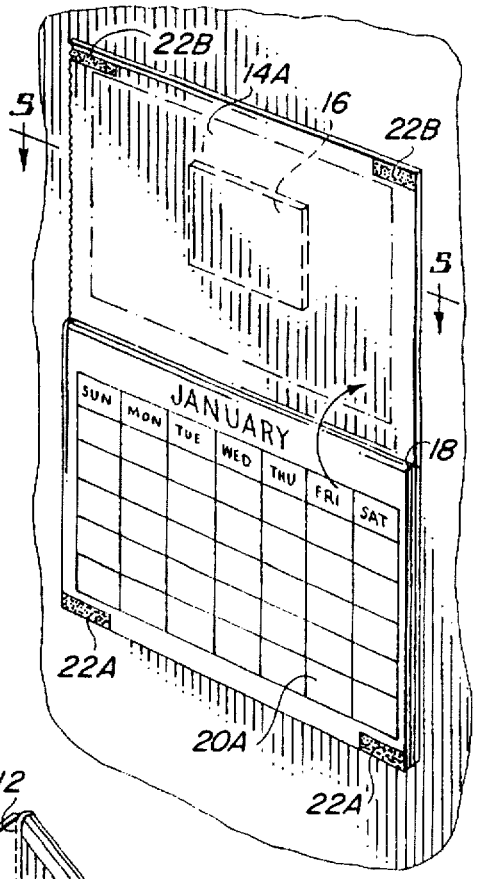
FIG. 3 is a front perspective view of the preferred embodiment of the invention with a portion shown in FIGS. 1 and 2 removed.
Figure 4:
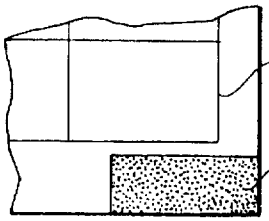
FIG. 4 is a detail of a portion of the embodiment shown in FIG. 3.

By placing the magnet 16 in the position shown in the various figures of the drawing, the calendar portion of the combination then can be magnetically attached to a suitable metallic wall surface (such as a refrigerator) by means of the magnet 16, as shown most clearly in FIG. 3.

When a magnet 16 is used to attach the calendar to a wall surface, some provision needs to be made to permit the calendar pages to be folded upwardly and secured in place over the face of the backing portion 14A to display each new month in turn. One manner of accomplishing this is to apply an adhesive material 22A to the lower corners of each of the sheets 20A and 20B, as illustrated most clearly in FIGS. 3 and 7. Material of the type which is suitable for doing this is the peel-off adhesive commonly used in the popular POST-IT® reminder notes which are in widespread use today. Thus, when the sheet for the month of January, for example, is to be moved upward to reveal the next succeeding month (February), it is peeled away from the next underlying surface 20A and moved in the direction of the arrow in FIG. 7. The adhesive material 22A then engages the upper corners 22B shown in FIG. 3 on the backing panel 14A and secures the sheet in that position. Consequently, there is no need for any nail or other projection to extend through a hole in the calendar, as is commonly used when a calendar is mounted on a wall. Each of the successive sheets 20A and 20B may be folded upwardly in the direction of the arrow shown in FIG. 7 to secure them against the surface 14A and one another, in succession, until the entire year display has been effected.

Figure 8:
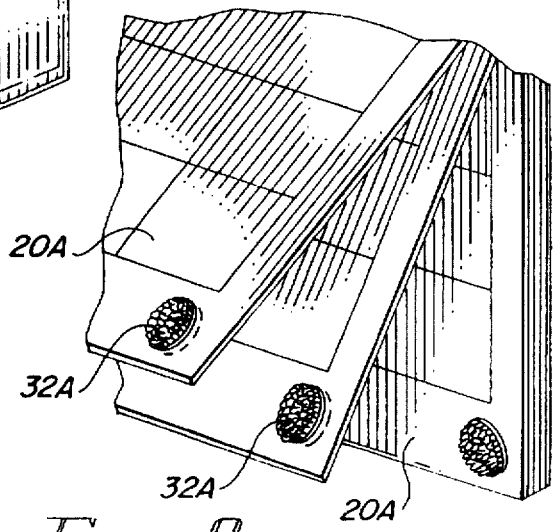
FIG. 8 is a detail showing an alternative embodiment of the feature of the invention shown in FIG. 1 through 7.

FIG. 8 illustrates an alternative to the use of a "peelable" adhesive and discloses small VELCRO® dots 32A attached in the lower corners in the same positions as the removable adhesive 22A shown in FIGS. 3 and 7. Corresponding VELCRO® material of the opposite type then is placed on the reverse side of each of the sheets to permit the holding in place of the sheets against the upper portion 14A of the calendar back during use of the calendar.

Obviously, the adhesive portions 22A or the VELCRO® fasteners 22A are not required if the calendar is to be hung in a standard manner on a nail, with the various sheets being secured by aligned holes; so that they may be folded upwardly in standard fashion to be placed over a nail extending through a corresponding hole (not shown) in the top center, for example, of the upper portion 14A of the calendar structure.

In the construction of the card/calendar combination disclosed, it is desirable to fabricate the parts 11A/11B and 14A/14B of heavier stock than the calendar pages 20A/20B. This is not necessary, however, and the stock used for all of the different parts of the card/calendar may be of equal weight. In most cases, however, it is desirable to form the blank forming the portions 11 and 14 out of heavier stock than the remaining pages 20A/20B to provide additional rigidity to the greeting card and calendar backing portion of the assembly.

The foregoing description of the preferred embodiment of the invention is to be considered illustrative and not as limiting. Various changes will occur those skilled in the art for performing substantially the same function, in substantially the same way, to achieve substantially the same result without departing from the true scope of the invention as defined in the appended claims.

What is claimed is:

1. A combined greeting card and wall display calendar comprising:

a calendar backing panel of substantially rectangular shape with first and second portions separated by a first fold line; and a card panel of substantially rectangular shape removably attached at a second fold line to said first portion of said calendar backing panel, said second fold line being perpendicular to said first fold line wherein each of said first and second portions of said calendar backing panel and said card panel comprise rectangles of substantially the same size.

2. The combination according to claim 1 wherein said calendar backing panel and said card panel each have front and back surfaces, and said first fold line is oriented to cause the front surface of said first portion of said calendar backing panel to overlie said second portion thereof and said second fold line is oriented to cause the back surface of said card panel to overlie the back surface of said first portion of said calendar backing panel when said combined greeting card and wall display calendar is folded for shipping and storage.

3. The combination according to claim 2 further including a plurality of calendar pages of substantially the same dimensions as said calendar backing panel and including first and second portions separated by a third fold line which is secured to said first fold line of said calendar backing panel, with said pages normally folded over at said third fold line to extend downwardly from said third fold line to overlie said second portion of said calendar backing panel.

4. The combination according to claim 3 wherein said rear surface of said first portion of said calendar backing panel has a wall securing device attached thereto.

5. The combination according to claim 4 wherein said wall attachment device comprises a magnet.

6. The combination according to claim 5 wherein said magnet comprises a flat sheet of magnetic material.

7. The combination according to claim 6 wherein said calendar pages are releasably secured to one another, with the first portion of said calendar page immediately adjacent said calendar backing panel being releasably secured to said first portion of said calendar backing panel.

8. The combination according to claim 7 wherein said calendar pages are releasably secured by a releasable adhesive.

9. The combination according to claim 7 wherein said calendar pages are releasably secured by a hook and loop fastener device.

10. The combination according to claim 1 further including a plurality of calendar pages of substantially the same dimensions as said calendar backing panel and including first and second portions separated by a third fold line which is secured to said first fold line of said calendar backing panel, with said pages normally folded over at said third fold line to extend downwardly from said third fold line to overlie said second portion of said calendar backing panel.

11. The combination according to claim 1 wherein said rear surface of said first portion of said calendar backing panel has a wall securing device attached thereto.

12. The combination according to claim 11 wherein said wall securing device comprises a magnet.

* * * * *